US005421585A

United States Patent [19]

Ruvio

[11] Patent Number: 5,421,585

[45] Date of Patent: Jun. 6, 1995

[54] FLOATING WATER GAME

[76] Inventor: Francesco Ruvio, 1922 E. 28th St., Brooklyn, N.Y. 11229

[21] Appl. No.: 324,097

[22] Filed: Oct. 17, 1994

[51] Int. Cl.[6] ..... A63B 67/06

[52] U.S. Cl. ..... 273/338; 273/350

[58] Field of Search ..... 273/336, 337, 338, 339, 273/350, 411

[56] References Cited

U.S. PATENT DOCUMENTS

| | | | |
|---|---|---|---|
| 1,617,127 | 2/1927 | Levay | 273/339 |
| 3,652,090 | 3/1972 | Stemmans | 273/336 |
| 4,120,499 | 10/1978 | Stazzone | 273/338 |
| 4,433,841 | 2/1984 | Kim et al. | 273/338 |

*Primary Examiner*—William H. Grieb

*Attorney, Agent, or Firm*—Michael I. Kroll

[57] ABSTRACT

A floating water game comprising a plurality of pins, each similar in shape to a bowling pin. An assembly is for floating each pin in an upright position on a body of water. An article is for stabilizing and spacing each pin apart from the other pins on the body of water. Fasteners are for attaching in a removable manner the stabilizing and spacing articles of the pins, so that the pins form a particular geometric configuration on the body of water. Indicia is on each pin to indicate a specific amount of points for each pin. Components are used by each player, for tossing at the pins to determine if contact was made onto the pins. Each player can receive the amount of points indicated, in which the player with the highest score at the end of the game wins.

14 Claims, 2 Drawing Sheets

FLOATING WATER GAME

BACKGROUND OF THE INVENTION

1. Field of the Invention

The instant invention relates generally to games and more specifically it relates to a floating water game.

2. Description of the Prior Art

Numerous games have been provided in prior art that are playing activities, in which people take part in, so that competition is achieved accordingly to a particular set of rules, allowing the people to strive to win. While these units may be suitable for the particular purpose to which they address, they would not be as suitable for the purposes of the present invention as heretofore described.

SUMMARY OF THE INVENTION

A primary object of the present invention is to provide a floating water game that will overcome the shortcomings of the prior art devices.

Another object is to provide a floating water game that is fun and exciting, in which skill, coordination and imagination is required by each player playing the game.

An additional object is to provide a floating water game containing a plurality of interconnecting upright floating pins placed in a triangular configuration in a body of water, so that each player can toss rings or balls at the pins to receive points when making contact with the pins, in which the player with the highest score at the end of the game wins.

A further object is to provide a floating water game that is simple and easy to use.

A still further object is to provide a floating water game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
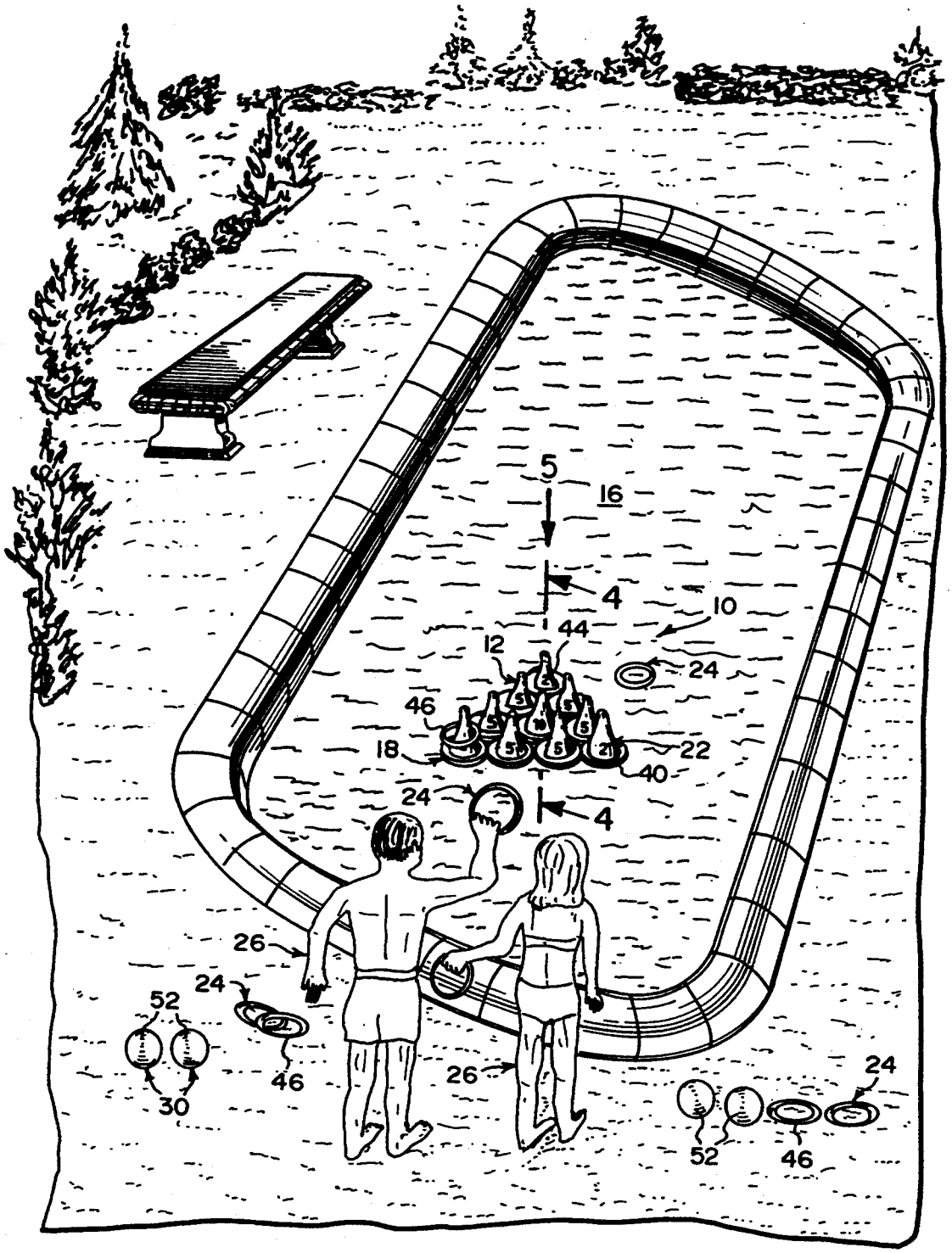
FIG. 1 is a top perspective view showing the instant invention in use in a pool being played by two players.
Figure 2:
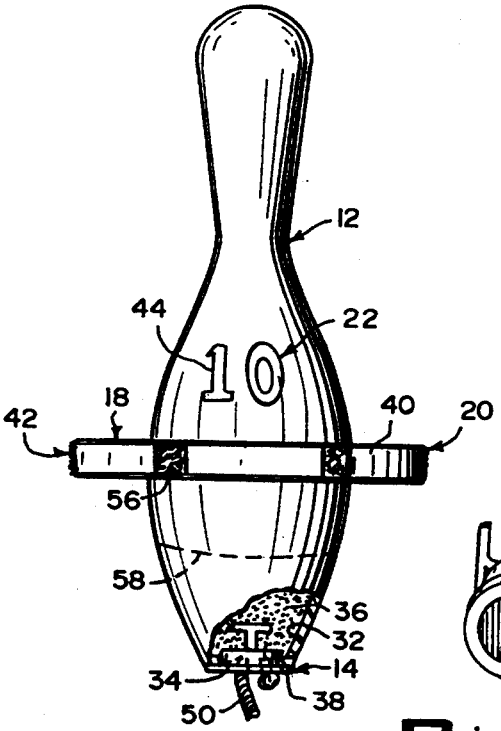
FIG. 2 is an enlarged elevational view of the central ten pin and its associated collar with parts broken away and in section.

Turning now descriptively to the drawings, in which similar reference characters denote similar elements throughout the several views, FIG. 1 illustrates a floating water game 10, comprising a plurality of pins 12, each similar in shape to a bowling pin. An assembly 14, best seen in FIG. 2, is for floating each pin 12 in an upright position on a body of water 16. An article 18 is for stabilizing and spacing each pin 12 apart from the other pins 12 on the body of water 16. Fasteners 20 are for attaching in a removable manner the stabilizing and spacing articles 18 of the pins 12, so that the pins 12 form a particular geometric configuration on the body of water 16. Indicia 22 on each pin 12, is to indicate a specific amount of points for each pin 12. Components 24 are used by each player 26, for tossing at the pins 12 to determine if contact was made onto the pins 12. Each player 26 can receive the amount of points indicated, in which the player 26 with the highest score at the end of the game 10 wins.

Figure 4:
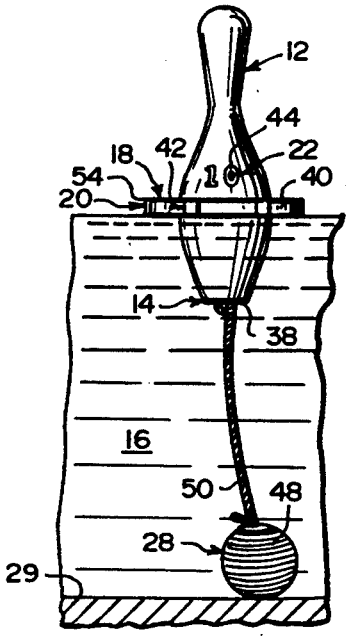
FIG. 4 is a cross sectional view taken along line 4—4 in FIG. 1, showing the ten pin with its anchor in the pool.

A structure 28, shown in FIG. 4, is for anchoring one of the pins 12 to the floor 29 of the body of water 16, so as to keep the geometric configuration of the pins 12 stationary on the body of water 16.

Elements 30 are used by each player 26 for throwing at the pins 12, to determine if contact was made in a pocket between some of the pins 12. Each player 26 can receive the amount of points awarded for making the pocket, in which the player 26 with the highest score at the end of the game wins.

Figure 3:
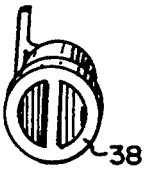
FIG. 3 is a bottom perspective view of the plug shown in FIG. 2.

Each upright position floating assembly 14, as best seen in FIG. 2, includes the pin 12 being hollow having a chamber 32 with a bottom entrance port 34. A weighted material 36, such as sand, gravel or water is inserted through the bottom entrance port 34 and into a lower segment of the chamber 32. A plug 38, best seen in FIG. 3, is to seal the bottom entrance port 34. Each stabilizing and spacing article 18 is a collar 40, extending about the middle of the pin 12. The collar 40 can be affixed to the pin 12. The collar 40 can also be an integral part of the pin 12.

Figure 5:
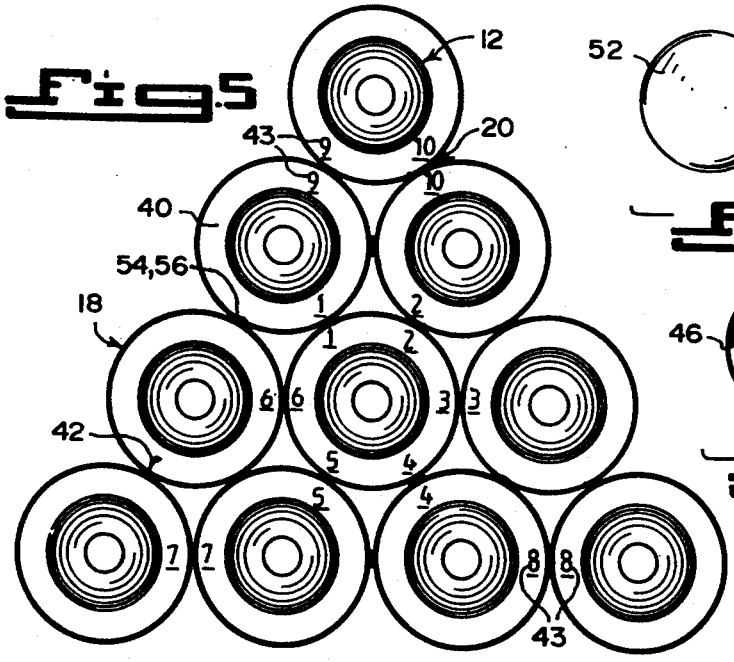
FIG. 5 is a top view taken in the direction of arrow 5 in FIG. 1, showing just the triangular configuration set up of all the pins.

The attaching fasteners 20 are a plurality of mounting tabs 42, spaced apart on the perimeter of each collar 40 in a special pattern. Indicator markings 43 are on top of each collar 40 adjacent the mounting tabs 42. The mounting tabs 42 can be placed in contact with each other in the special pattern, by matching up the indicator markings 43 to make the geometric configuration of the pins 12, as best seen in FIG. 5. The geometric configuration includes ten pins 12 in a triangle motif, with one of the pins 12 being in the center.

The indicia 22 are numbers 44, in which one indicia 22 is numbered "10" representing ten points on the center pin 12, six indicia 22 are numbered "5" representing five points on each of the six pins 12 about the center pin 12 and three indicia 22 are numbered "2" representing two points on each of the three end pins 12.

Figure 7:
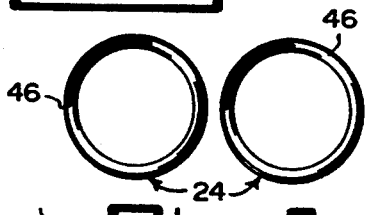
FIG. 7 is a top view of two of the rings used in playing the game.

The tossing components 24, as best shown in FIG. 7, are a plurality of hollow rings 46. Each ring 46 is tossed by each player 26 to go onto one pin 12, so that the player 26 will receive the amount of points indicated.

The anchoring structure 28 contains a weighted ball 48, to rest upon the bottom floor 29 of the body of water 16. An elongated cord 50 extends upwardly from the weighted ball 48 and is attached to the plug 38 of the center pin 12.

Figure 6:
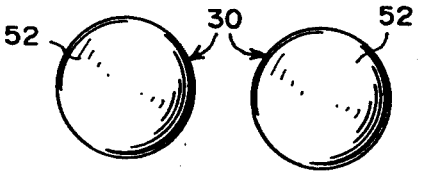
FIG. 6 is a top view of two of the balls used in playing the game.

The throwing elements 30, as best shown in FIG. 6, are a plurality of hollow balls 52. Each ball 52 is thrown by each player 26, to go into one pocket between some of the pins 12, so that the player 26 will receive the amount of points awarded.

Each mounting tab 42 can be a magnet 54. Each mounting tab 42, can also be one of a mating hook and loop pile fastener material strip 56.

Each pin 12 further includes a plastic liner sheet 58, shown in a dotted line in FIG. 2. The plastic liner sheet 58 is an integral part of the pin 12 within the chamber 32, to form a top enclosure for the lower segment of the chamber 32. The plastic liner sheet 58 will keep the weighted material 36 stabilized therein.

LIST OF REFERENCE NUMBERS

10 floating water game
12 pin
14 upright position floating assembly in 12
16 body of water
18 stabilizing and spacing article on 12
20 attaching fastener on 18
22 indicia on 12
24 tossing component
26 player
28 anchoring structure for 12
29 floor of 16
30 throwing element
32 chamber in 12
34 bottom entrance port in 12
36 weighted material in 32
38 plug in 34
40 collar for 18
42 mounting tab of 20
43 indicator marking on 18
44 number for 22
46 hollow ring for 24
48 weighted ball
50 elongated cord
52 hollow ball for 30
54 magnet for 42
56 mating hook and loop pile fastener material strip for 42
58 plastic liner sheet of 12 in 32

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A floating water game comprising:

a) a plurality of pins, each similar in shape to a bowling pin;

b) means for floating each said pin in an upright position on a body of water;

c) means for stabilizing and spacing each said pin apart from said other pins on the body of water;

d) means for attaching in a removable manner said stabilizing and spacing means of said pins, so that said pins form a particular geometric configuration on the body of water;

e) indicia on each said pin to indicate a specific amount of points for each said pin; and f) means used by each player, for tossing at said pins to determine if contact was made onto said pins, so that each player can receive the amount of points indicated, in which the player with the highest score at the end of the game wins.

2. A floating water game as recited in claim 1, further including means for anchoring one of said pins to the floor of the body of water, so as to keep said geometric configuration of said pins stationary on the body of water.

3. A floating water game as recited in claim 2, further including means used by each player for throwing at said pins to determine if contact was made in a pocket between some of said pins, so that each player can receive the amount of points awarded for making the pocket, in which the player with the highest score at the end of the game wins.

4. A floating water game as recited in claim 3, wherein each said floating means includes:

a) said pin being hollow having a chamber with a bottom entrance port;

b) a weighted material inserted through said bottom entrance port and into a lower segment of said chamber; and c) a plug to seal said bottom entrance port.

5. A floating water game as recited in claim 4, wherein each said stabilizing and spacing means is a collar affixed to and extending about the middle of said pin, whereby in one instance said collar can be affixed to said pin and in another instance, said collar can be an integral part of said pin.

6. A floating water game as recited in claim 5, wherein said attaching means includes:

a) a plurality of mounting tabs, spaced apart on the perimeter of each said collar in a special pattern; and b) indicator markings on top of each said collar adjacent said mounting tabs, so that said mounting tabs can be placed in contact with each other in said special pattern by matching up said indicator markings, to make said geometric configuration of said pins.

7. A floating water game as recited in claim 6, wherein said geometric configuration includes ten said pins in a triangle motif, with one of said pins being in the center.

8. A floating water game as recited in claim 7, wherein said indicia are numbers, in which one said indicia is numbered "10" representing ten points on said center pin, six said indicia are numbered "5" representing five points on each of said six pins about said center pin and three said indicia are numbered "2" representing two points on each of said three end pins.

9. A floating water game as recited in claim 8, wherein said tossing means includes a plurality of hollow rings, each said ring is tossed by each player to go onto one said pin, so that the player will receive the amount of points indicated.

10. A floating water game as recited in claim 9, wherein said anchoring means includes:

a) a weighted ball to rest upon the bottom floor of the body of water; and b) an elongated cord extending upwardly from said weighted ball and attached to said plug of said center pin.

11. A floating water game as recited in claim 10, wherein said throwing means includes a plurality of hollow balls, each said ball is thrown by each player to go into one pocket between some of said pins, so that the player will receive the amount of points awarded.

12. A floating water game as recited in claim 11, wherein each said mounting tab is a magnet.

13. A floating water game as recited in claim 11, wherein each said mounting tab is one of a mating hook and loop pile fastener material strip.

14. A floating water game as recited in claim 11, wherein each said pin further includes a plastic liner sheet being an integral part of said pin within said chamber to form a top enclosure for the lower segment of said chamber, so as to keep said weighted material stabilized therein.

* * * * *